United States Patent [19]

Persson

[11] 4,343,428

[45] Aug. 10, 1982

[54] TRAY WITH HANDLES

[75] Inventor: Karl R. Persson, Halmstad, Sweden

[73] Assignee: Sprinter System AB, Sweden

[21] Appl. No.: 178,114

[22] Filed: Aug. 13, 1980

[30] Foreign Application Priority Data

Jul. 27, 1979 [SE] Sweden ..... 7906437

[51] Int. Cl.[3] ..... B65D 5/24

[52] U.S. Cl. ..... 229/31 R; 229/31 FS; 229/52 B

[58] Field of Search ..... 229/31 R, 31 FS, 32, 229/33, 34 R, 34 A, 34 B, 52 B

[56] References Cited

U.S. PATENT DOCUMENTS

| | | | |
|---|---|---|---|
| 1,965,138 | 7/1934 | Dunlap | 229/31 R |
| 3,275,215 | 9/1966 | Paige | 229/31 FS |
| 3,316,102 | 4/1967 | Doll | 229/31 FS |
| 4,260,098 | 4/1981 | Manizza | 229/31 FS |

*Primary Examiner*—Herbert F. Ross

*Attorney, Agent, or Firm*—Ostrolenk, Faber, Gerb & Soffen

[57] ABSTRACT

The invention relates to a tray having two handle configurations along two opposing side walls, the configurations comprising extensions in the form of flaps extending obliquely outward and downward from the upper edge portion of the two side walls, the flaps being held in position by being secured to projections extending from the ends of the two other side walls.

19 Claims, 3 Drawing Figures

Fig. 1
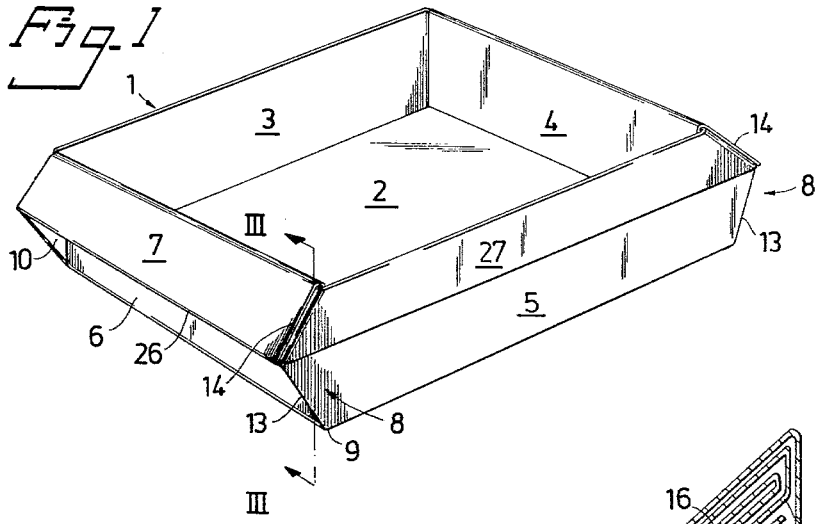
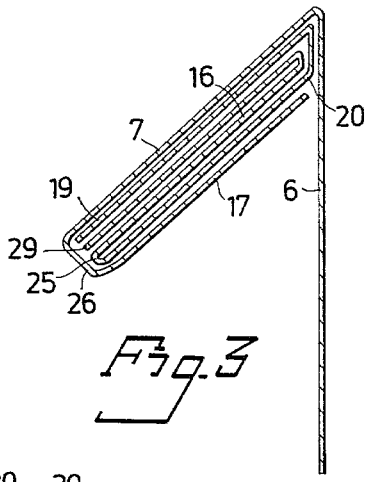
Fig. 3
Fig. 2
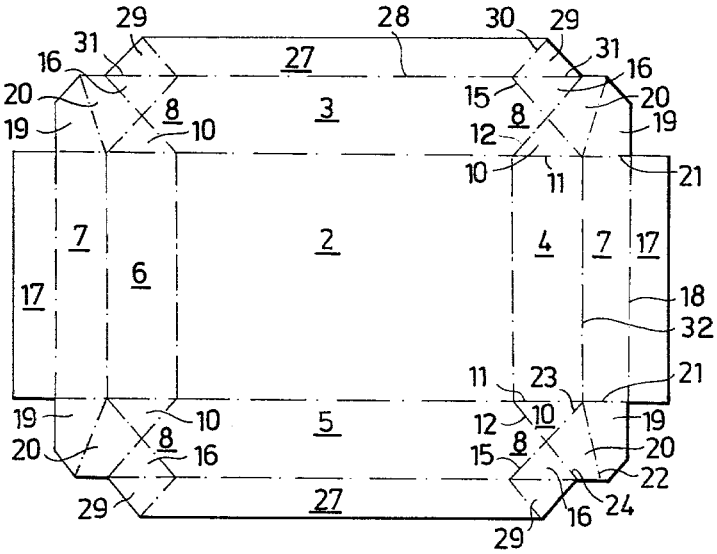

TRAY WITH HANDLES

BACKGROUND OF THE INVENTION

The present invention relates to a tray, particularly intended for foodstuffs and made from a blank stamped and creased from carton or similar stiff material, the tray consisting of a bottom and four side walls, the latter being joined to each other in pairs.

SUMMARY OF THE INVENTION

The object of the present invention is to provide a tray which, apart from use for conveying, storing and/or serving foodstuffs, can also be used for foodstuffs intended to be heated in an oven, e.g. an electronic oven, such that the tray is easy to handle after being heated without the handler receiving burn injuries, due to two opposing side walls thereof being provided with handles extending along them. As a result of the way the handles are formed, they are very comfortable to grip while giving great stability to the whole tray at the same time, which is particularly important when the tray has a large bottom surface, e.g. when being used for pizzas. The comfortable grips is a result of the special manner of attachment of the handles at the corner portions of the tray.

This object is achieved by means of the present invention, which provides a tray of the kind described above, and which is essentially distinguished by the fact that two of its opposing side walls are extended at their upper edges with flaps bent outwards and downwards at an angle of less than 90° to the plane of the side wall, where they are fixed in that dependent position to a projection on the respective adjacent side wall. The projection constitutes an extension of the latter wall and, starting from the upper edge of the side wall at the respective corner portion of the tray, extends a predetermined distance, preferably at the same angle as the flap, returning thereafter towards the side wall plane to end at the bottom corner of the tray, the flaps thus forming two opposingly disposed handles along the walls on the outside of the tray.

BRIEF DESCRIPTION OF THE DRAWING

The invention will now be described in detail while referring to the attached drawing, in which:

FIG. 1 is a perspective view of a preferred embodiment of a tray in accordance with the present invention, FIG. 2 is a plan view of a blank for forming the tray illustrated in FIG. 1 and;

FIG. 3 is a vertical section taken through one of the side walls provided with a handle at a point near the head of the wall.

DETAILED DESCRIPTION OF THE PREFERRED EMBODIMENT

The tray 1 illustrated in FIG. 1 is preferably manufactured from carton or similar stiff material, which is preferably coated on at least one side with a plastic film, e.g. polyester, resistent to high temperature. The tray 1 has a bottom 2 and four side walls 3,4,5,6, joined to each other in pairs. Two opposing side walls 4,6 are each extended at their upper edges as a flap 7, folded at an angle less than 90°, and preferably about 45°, to the plane of the side wall 4,6. The flap 7 is fixed in this angular position by being secured to an extension of the respective side wall 3,5 which has the form of a triangular projection 8, situated outside the plane of the respective side wall 4,6. Each projection 8 has an upper edge 14, extending from the top of the side wall 4,6 to the top of the side wall 4,6 to the apex of the triangle (i.e. the point of the projection 8 which extends farthest outward laterally), and a lower edge 13 extending from the apex to the bottom of the side wall 4,6. The flaps 7 forming the handles of the tray 1 are preferably fixed, by means of heat-sealing or gluing performed, subsequent to a special folding operation described in detail below, against the upper edge 14 of the projection 8, the downwardly directed slope of the upper edge 14 being the same as that of the flap 7 in relation to the plane of the side walls 4,6.

By means of crease lines, the blank in FIG. 2 is divided into a bottom 2 and four side walls 3,4,5,6. The side walls 4,6 are continuous with flaps 7 from which they are separated by crease lines 32. Flaps 7 are each continuous with a further flap 17 from which they are separated by crease lines 18. Flaps 17 provide positional fixation and extra stabilization of the handles in a manner described below. Between the side walls 3,5 and 4,6 and flaps 7 there are side areas 10, connecting areas 16 and corner joining areas 19,20, all of which are articulatedly connected to each other and to the side walls 3–6 and flaps 7 along crease lines 11,12,15,21,22,23 and 24. The side walls 3,5 can also be provided with an edge flap 27 articulated along crease lines 28 and 31, this flap 27 having an area 29 intended for folding into the corner structure of the tray 1 by means of crease lines 30 and 31.

The blank illustrated in FIG. 2 is erected so that the side areas 10 are brought into engagement with the inside of the projections 8, the side areas 10 completely covering the extension of the side walls 3,5, since they have the same form and area. The edge flaps 27 are thereafter folded in, with their associated triangular end areas 29, along the crease lines 31,28, 31 into abutment against the side walls 3,5 and joining areas 16, if this has not been done at an earlier stage. The flaps 7 are then bent down to form a predetermined angle with the plane of the side walls 4,6 while simultaneously the corner joining areas 19,20 and the areas 16 and 29 are folded in along the crease lines 21,22,15,30 into mutual engagement, the end flaps 17 finally being folded 180° along their crease lines 18 into abutment against the underside of the handle, the respective area and flap lying against each other in the order relative to each other which will be seen from the cross section illustrated in FIG. 3. From FIG. 3 it can also be seen how the edge portions 25 and 26, formed by the folds illustrated in FIG. 2 along the crease lines 24,18, are placed in relation to each other.

I claim:

1. A tray of the type which is made from a blank of a stiff material and creased, said tray comprising:

a bottom;

first, second, third and fourth upstanding side walls, each said side wall having a bottom edge joined to said bottom and each having two opposite side ends; said first and third side walls each being adjacent to each of said second and fourth side walls; and each said side wall having a top edge opposite its bottom edge;

first and second flaps extending outward and downward from said top edge of said first and third side walls and defining an angle less than 90° therewith; each said flap having two side ends;

said second and fourth side walls each having a triangular projection in the plane thereof, at each side end thereof, each said projection being defined by an upper edge and a lower edge which intersect; and respective securing means maintaining each said side end of each said flap adjacent and stationary relative to said upper edge of a respective said projection, whereby said flaps define handles at opposite sides of said tray.

2. A tray as claimed in claim 1, wherein the angle of incline of said upper edges of said projections relative to the adjacent said side wall is equal to said angle defined between said respective side wall and said flap which is secured thereto.

3. A tray as claimed in claim 1, wherein said securing means comprises four side areas of said stiff material, each said side area being integral and continuous with one said side end of one of said side walls which have a flap secured thereto and also with said lower edge of the adjacent said projection.

4. A tray as claimed in claim 3, wherein each said side area lies flat against the adjacent said projection.

5. A tray as claimed in claim 1, wherein said securing means comprises four joining areas of said stiff material, each said joining area being articulatedly secured to said upper edge of a respective said projection.

6. A tray as claimed in claim 1, wherein said first and second flaps each have an edge opposite said edges at which said flaps are respectively secured to said first and third side walls; said securing means comprising first and second end flaps which are respectively secured to said first and second flaps along said opposite edges, each said end flap being secured in a position intermediate the adjacent said flap and said side wall to which its said adjacent flap is attached.

7. A tray as claimed in claim 3, wherein each said side area is also attached to said lower edge of the corresponding said projection.

8. A tray as claimed in claim 1, wherein said angle is 45°.

9. A tray as claimed in claim 4, wherein said securing means further comprises eight corner joining areas of said stiff material, a first four of said corner joining areas being continuous and integral with respective ones of said side areas and each of the remaining four of said corner joining areas being continuous and integral with a respective end of one of said flaps and with the adjacent one of said four corner joining areas which are continuous and integral with said side areas; each said corner joining area lying between one of said flaps and the adjacent said end flap, each of said first four corner joining areas lying immediately adjacent their respective said end flap and each of the second four said corner joining areas lying immediately adjacent their respective said flap.

10. A tray as claimed in claim 9, further comprising four joining areas of stiff material, each said joining area being articulatedly secured to a respective said projection along said upper edge thereof; and each said joining area lying between a respective one of the first four said corner joining areas and the adjacent one of the second four said corner joining areas.

11. A tray as claimed in claim 10, further comprising first and second edge flaps which are respectively continuous and integral with said top edges of said second and fourth side walls and which lie flat against the outer surfaces thereof.

12. A tray as claimed in claim 11, wherein a triangular portion at each side end of each said edge flap is disposed between a respective one of said flaps and the adjacent said end flap, for holding its respective said edge flap flat against its respective said side wall.

13. A tray of the type which is made from a blank of a stiff material and creased, said tray comprising:

a bottom;

first, second, third and fourth upstanding side walls; each said side wall having a bottom edge joined to said bottom and each having two opposite side ends; said first and third side walls each being adjacent to both of said second and fourth side walls; and each said side wall having a top edge opposite its said bottom edge;

first and second flaps extending outward and downward from said top edge of said first and third side walls and defining an angle less than 90° therewith; each said flap having two side ends;

said second and fourth side walls each having a triangular projection at each side end thereof, each said projection being defined by an upper edge and a lower edge which intersect; and respective securing means maintaining each said side end of each said flap adjacent and stationary relative to said upper edge of a respective said projection, whereby said flaps define handles at opposite sides of said tray, said securing means comprising:

four side areas of said stiff material lying flat against the adjacent said projection, each said side area being integral and continuous with one said side end of one of said side walls which have a flap secured thereto and also with said lower edge of the adjacent said projection;

eight corner joining areas of said stiff material, a first four of said corner joining areas being continuous and integral with respective ones of said side areas and each of the remaining four of said corner joining areas being continuous and integral with a respective end of one of said flaps and with the adjacent one of said four corner joining areas which are continuous and integral with said side areas; each said corner joining area lying between one of said flaps and the adjacent said end flap, each of said first four corner joining areas lying immediately adjacent their respective said end flap and each of the remaining four said corner joining areas lying immediately adjacent their respective said flap.

14. A tray as claimed in claim 13, further comprising four joining areas of stiff material, each said joining area being articulatedly secured to a respective said projection along said upper edge thereof; and each said joining area lying between a respective one of the first four said corner joining areas and the adjacent one of the second four said corner joining areas.

15. A tray as claimed in claim 14, further comprising first and second edge flaps which are respectively continuous and integral with said top edges of said second and fourth side walls and which lie flat against the outer surfaces thereof.

16. A tray as claimed in claim 15, wherein a triangular portion at each side end of each said edge flap is disposed between a respective one of said flaps and the adjacent said end flap, for holding its respective said edge flap flat against its respective said side wall.

17. A tray of the type which is made from a blank of a stiff material and creased, said tray comprising:

a bottom;

first, second, third and fourth upstanding walls each having a bottom edge secured to said bottom, a top edge opposite said bottom edge and side edges; said first and third walls being on opposite sides of said bottom;

first and second flaps respectively secured to said first and third walls, each said flap having one edge secured to the adjacent said wall along said top edge thereof;

each said flap having an edge opposite said first edge;

first and second end flaps secured to said first and second flaps, respectively, each said end flap having one edge secured to the respective said flap along said opposite edge thereof; each said end flap being disposed folded beneath the respective said flap and lying between said respective flap and the adjacent said wall to define a space between itself and said respective flap;

said second and fourth walls each having a respective triangular projection at each side end thereof, each said triangular projection being defined by an upper and a lower edge;

first and second edge flaps respectively secured to said second and fourth walls, each said edge flap having one edge secured to said top edge of its respective said wall and lying flat against the outer surface thereof; and a respective corner portion of said stiff material located at each said corner, each said corner portion being secured to the adjacent said walls, the adjacent said flap and the adjacent said edge flap, and being folded into said space defined between the adjacent said wall and the adjacent said end flap in such a manner as to secure the adjacent end of the adjacent said flap to said upper edge of the adjacent said triangular projection, thereby holding said adjacent flap in a fixed position relative to said wall to which it is secured; and each said corner portion comprising:

a triangular side area having one edge secured to the adjacent end of the adjacent said flap and having a second edge secured to said lower edge of the adjacent said triangular projection;

a triangular end area having one edge secured to the end of the adjacent said edge flap;

a triangular joining area having one edge secured to said end area and having a second edge secured to said upper edge of the adjacent said triangular projection;

a first corner joining area having one edge secured to said joining area and having a second edge secured to said side area; and a second corner joining area having one edge secured to said first corner joining area and having a second edge secured to the adjacent end of the adjacent said flap.

18. A blank of a stiff material for use in manufacturing a tray:

said blank being divided by crease lines into a plurality of regions; said regions comprising:

a bottom;

first, second, third and fourth walls each having a bottom edge secured to said bottom, a top edge opposite said bottom edge and side edges; said first and third walls being on opposite sides of said bottom;

first and second flaps respectively secured to said first and third walls, each said flap having one edge secured to the adjacent said wall along said top edge thereof;

each said flap having an edge opposite said first edge;

first and second end flaps secured to said first and second flaps, respectively, each said end flap having one edge secured to the respective said flap along said opposite edge thereof;

said second and fourth walls each having a respective triangular projection at each side end thereof, each said triangular projection being defined by an upper and a lower edge;

first and second edge flaps respectively secured to said second and fourth walls, each said edge flap having one edge secured to said top edge of its respective said wall; and a respective corner portion of said stiff material located at each said corner, each said corner portion being secured to the adjacent said walls, the adjacent said flap and the adjacent said edge flap; and each said corner portion comprising:

a triangular side area having one edge secured to the adjacent end of the adjacent said flap and having a second edge secured to said lower edge of the adjacent said triangular projection;

a triangular end area having one edge secured to the end of the adjacent said edge flap;

a triangular joining area having one edge secured to said end area and having a second edge secured to said upper edge of the adjacent said triangular projection;

a first corner joining area having one edge secured to said joining area and having a second edge secured to said side area; and a second corner joining area having one edge secured to said first corner joining area and having a second edge secured to the adjacent end of the adjacent said flap.

19. A blank of stiff material for use in manufacturing a tray, said blank being divided by crease lines into a plurality of regions; said regions comprising:

a bottom;

first, second, third and fourth walls each having a bottom edge secured to said bottom, a top edge opposite said bottom edge and side edges; said first and third walls being on opposite sides of said bottom;

first and second flaps respectively secured to said first and third walls, each said flap having one edge secured to the adjacent said wall along said top edge thereof;

each said flap having an edge opposite said first edge;

first and second end flaps secured to said first and second flaps, respectively, each said end flap having one edge secured to the respective said flap along said opposite edge thereof;

said second and fourth walls each having a respective triangular projection at each side end thereof, each said triangular projection being defined by an upper and a lower edge;

a respective corner portion of said stiff material located at each said corner, each said corner portion being secured to the adjacent said walls and the adjacent said flap, and each said corner portion comprising:

a triangular side area having one edge secured to the adjacent end of the adjacent said wall and having a second edge secured to said lower edge of the adjacent said triangular projection;

a triangular joining area having an edge secured to said upper edge of the adjacent said triangular projection;

a first corner joining area having one edge secured to said joining area and having a second edge secured to said side area; and a second corner joining area having one edge secured to said first corner joining area and having a second edge secured to the adjacent end of the adjacent said flap.

* * * * *